United States Patent [19]

Brücher et al.

[11] Patent Number: 5,029,637

[45] Date of Patent: Jul. 9, 1991

[54] HEAT EXCHANGER, ESPECIALLY FOR COOLING CRACKED GAS

[75] Inventors: Peter Brücher; Wolfgang Kehrer, both of Berlin, Fed. Rep. of Germany

[73] Assignee: Borsig GmbH, Berlin, Fed. Rep. of Germany

[21] Appl. No.: 440,608

[22] Filed: Nov. 22, 1989

[30] Foreign Application Priority Data

Dec. 19, 1988 [DE] Fed. Rep. of Germany ..... 3842727

[51] Int. Cl.[5] ..... F28F 19/00; F28F 9/22

[52] U.S. Cl. ..... 165/119; 165/174

[58] Field of Search ..... 165/174, 134.1, 119

[56] References Cited

U.S. PATENT DOCUMENTS 3,552,487 1/1971 Tokumitsu ..... 165/174
4,764,254 8/1988 Rosenblad ..... 165/119

FOREIGN PATENT DOCUMENTS 1000194 1/1957 Fed. Rep. of Germany ..... 165/174
1080002 3/1984 U.S.S.R. ..... 165/119
1146535 3/1985 U.S.S.R. ..... 165/174

*Primary Examiner*—John Rivell
*Assistant Examiner*—L.R. Leo
*Attorney, Agent, or Firm*—Max Fogiel

[57] ABSTRACT

A heat exchanger, especially for cooling cracked gas, with a nest of tubes secured between two tube plates (2) and with two terminal chambers (4) adjacent to the tube plates and tapering toward a connector (5). The intake-end chamber accommodates inserts. The inserts consist of rods bent into round or polygonal, concentrically positioned rings (7). The rings are positioned away from the tube plate in alignment with the intake-end connector in an area that essentially equals the connector's cross-section.

7 Claims, 2 Drawing Sheets

HEAT EXCHANGER, ESPECIALLY FOR COOLING CRACKED GAS

The invention concerns a heat exchanger, especially for cooling cracked gas, with the characteristics recited in the preamble to claim 1.

The gas supplied to the intake-end terminal chamber through the intake in a heat exchanger of this type expands with the cross-section of the terminal chamber. The flow is nonuniform in that less gas flows along the edge than along the axis.

A known heat exchanger (U.S. Pat. 3,552,487) has conical inserts in its intake-end terminal chamber to ensure that the flow through it will be uniform. The inserts are intended to distribute the incoming gas over the nest tubes. When this heat exchanger is employed to cool cracked gas, however, the gas tends to coke up on the large uncooled surface provided by the conical inserts, contaminating and obstructing the vicinity of the intake.

In another known heat exchanger (German Patent 2 160 372) contamination of the vicinity of the intake is avoided by attempting to attain a uniform flow without using inserts. A deflector that resembles a diffusor is accordingly positioned where the intake opens into the terminal chamber. The terminal chamber also accommodates a shroud with a perforated wall separated from the inner surface of the terminal chamber by an annual space. This system counteracts burbling at the inner surface and the incomplete formation of internal backflows.

Non-uniform flow through the intake-end terminal chamber and tube nest, however, is not the only problem to occur when cracked gas is cooled in a generic heat exchanger. Additional problems are caused by particles of carbon that derive from the manufacturing process and are entrained along with the gas being cooled. These particles of carbon concentrate in the vicinity of the axial flow and lead to erosion of the tube plate and tubes.

The object of the present invention is to provide a generic heat exchanger with inserts that will not only ensure uniform flow through the intake-end terminal chamber but also protect the tube plate from erosion.

This object is attained in accordance with the invention in a generic heat exchanger by the characteristics recited in the body of claim 1. Advantageous embodiments of the invention are recited in the subsidiary claims.

The particles of carbon entrained by the gas in the vicinity of the more rapid axial flow strike the rods in the insert, canceling out their kinetic energy. The accordingly braked particles are entrained by the gas and can no longer erode and damage the tube plate and tubes. The impacting gas can also to some extent be diverted radially outward by the insert. Enough gas, however, can still flow between the annular spacers to the tubes near the center of the plate. The rods can be appropriately positioned and dimensioned to ensure that all the tubes in the nest will be very uniformly supplied with gas. The gas will be diverted outward even more effectively when the rods, which are shaped into rings, constitute a cone.

Figure 1:
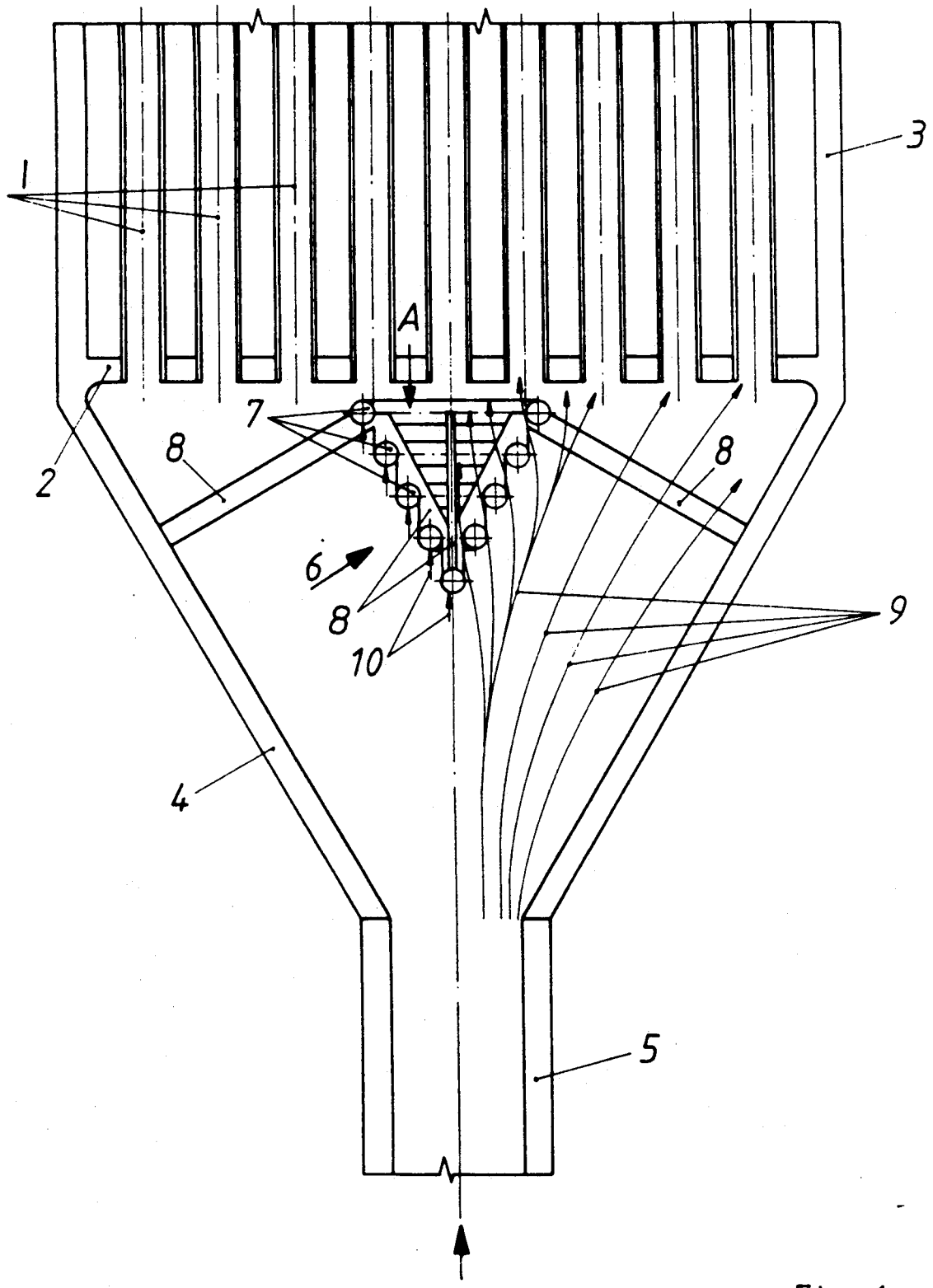
Figure 2:
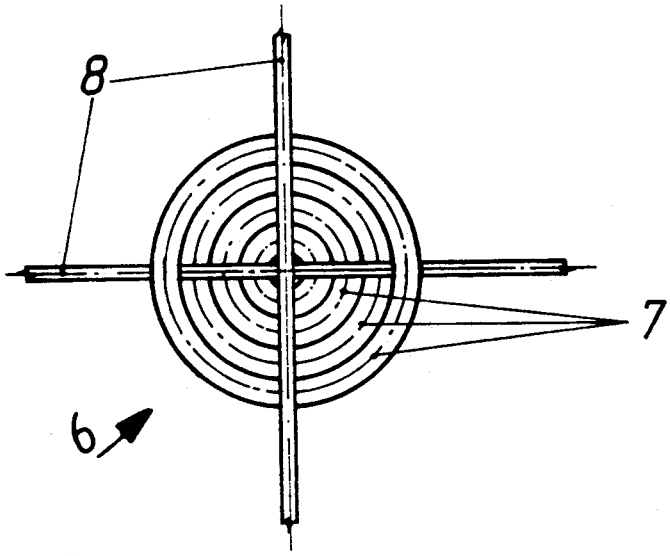

One embodiment of the invention will now be described with reference to the drawing, wherein FIG. 1 is a longitudinal section through a heat exchanger and FIG. 2 is the view along the direction indicated by arrow A in FIG. 1.

Only the intake end of a heat exchanger for cooling cracked gas is illustrated. The heat exchanger consists of a nest of straight tubes 1 secured in two tube plates 2 at each end. The nest is accommodated in an outer jacket 3, demarcating in conjunction with tube plates 2, a space that boiling water subject to high pressure flows through. One terminal chamber 4 is adjacent to the tube plate 2 at the illustrated gas-intake end and another to the plate at the unillustrated gas-outlet end. Each terminal chamber is provided with a connector 5 for admitting or emitting gas. The diameter of connector 5 is considerably shorter than that of tube plate 2, with each terminal chamber 4 tapering accordingly.

Separated from the tube plate 2 at the gas-intake end is an insert 6 that functions as a distributor and as an anti-impact fender. Insert 6 is restricted to the section of tube plate 2 in the vicinity of the axial flow of the gas supplied through connector 5 and hence most exposed to erosion. Insert 6 is made out of sectional or round rods shaped into polygonal or round rings 7. Insert 6 can be flat, with the rings positioned concentrically and in one plane. It is, however, an advantage for rings 7 to be in the shape of a cone pointing toward connector 5 as illustrated. Rings 7 are axially separated. The outside diameter of one ring 7 more or less equals the inside diameter of the next ring 7 toward tube plate 2. The diameter of the ring 7 adjacent to tube plate 2 is slightly larger than that of connector 5. The area of projection of connector 5 on tube plate 2 is accordingly completely covered. Rings 7 are also connected to intersecting webs 8 secured to the wall of terminal chamber 4.

As indicated by arrows 9 on the right side of FIG. 1, some of the incoming gas is deflected at the edge and some travels through the rings 7 in insert 6. The diameter of the rods that are shaped into rings 7 and the distances between them can be long enough to ensure that the gas is uniformly distributed over the cross-section of tube plate 2. As indicated by the arrows 10 on the left of FIG. 1, the particles of carbon that are entrained by the gas and flow in a straight line strike against rings 7 and are braked. The displacement of rings 7 prevents the particles from impacting against tube plate 2 at high speeds.

We claim:

1. A heat exchanger for cooling cracked gas, comprising: two tube plates; a nest of tubes secured between said tube plates; two terminal chambers adjacent to said tube plates; connectors connected to said terminal chambers, said terminal chambers tapering toward said connectors; one of said terminal chambers comprising an intake-end chamber; an insert in said intake-end chamber and having rods bent into concentrically positioned rings with gaps between said rings, one of said connectors being an intake-end connector having a cross-sectional area and connected to said intake-end chamber, one of said tube plates communicating with said intake-end chamber; said rings being positioned away from said one tube plate and in alignment with said intake-end connector in an area equal substantially to the cross-sectional area of said intake-end connector for protecting said intake-end chamber and said one tube plate against erosion from cracked gas flow entering said intake-end chamber through said intake-end connector and deflecting said cracked gas partly radially outward; said insert dividing said cracked gas flow entering said intake-end chamber into a central partial flow passing through said insert and into a partial outward deflected flow impinging directly on said one tube plate and being a peripheral flow without passing through said insert, said insert slowing down particles in said cracked gas and concentrated ion a region of said central partial flow and carried along by the gas flow through gaps between said rings, the particles in said cracked gas striking said rings without striking said one tube plate.

2. A heat exchanger as defined in claim 1, wherein said rings are positioned along a surface of a cone having an apex pointing toward said intake-end connector.

3. A heat exchanger as defined in claim 2, wherein one of said rings has an outside diameter equal to an inside diameter of a next ring toward said one tube plate.

4. A heat exchanger as defined in claim 1, wherein said rods are arranged for uniform contact of all tubes in said nest by said cracked gas.

5. A heat exchanger as defined in claim 1, wherein said rods are bent into round concentrically positioned rings.

6. A heat exchanger as defined in claim 1, wherein said rods are bent into polygonal concentrically positioned rings.

7. A heat exchanger for cooling cracked gas, comprising: two tube plates; a nest of tubes secured between said tube plates; two terminal chambers adjacent to said tube plates; connectors connected to said terminal chambers, said terminal chambers tapering toward said connectors; one of said terminal chambers comprising an intake-end chamber; an insert in said intake-end chamber and having rods bent into concentrically positioned rings with gaps between said rings, one of said connectors being an intake-end connector having a cross-sectional area and connected to said intake-end chamber, one of said tube plates communicating with said intake-end chamber; said rings being positioned away from said one tube plate and in alignment with said intake-end connector in an area equal substantially to the cross-sectional area of said intake-end connector for protecting said intake-end chamber and said one tube plate against erosion from cracked gas flow entering said intake-end chamber through said intake-end connector and deflecting said cracked gas partly radially outward; said rings being positioned along a surface of a cone having an apex pointing toward said intake-end connector; one of said rings having an outside diameter equal to an inside diameter of a next ring toward said one tube plate; said rods being arranged for uniform contact of all said tubes of said nest by the cracked gas; said rods being bent into round concentrically positioned rings; said insert dividing said cracked gas flow entering said intake-end chamber into a central partial flow passing through said insert and into a partial outward deflected flow impinging directly on said one tube plate and being a peripheral flow without passing through said insert, said insert slowing down particles in said cracked gas and concentrated in a region of said central partial flow and carried along by the gas flow through gaps between said rings, the particles in said cracked gas striking said rings without striking said one tube plate.

* * * * *